US006527166B1

(12) United States Patent
Focke et al.

(10) Patent No.: US 6,527,166 B1
(45) Date of Patent: Mar. 4, 2003

(54) BOX WITH A HINGED LID, FOR CIGARETTES

(75) Inventors: Heinz Focke, Verden (DE); Henry Buse, Visselhövede (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/857,696

(22) PCT Filed: Nov. 30, 1999

(86) PCT No.: PCT/EP99/09307

§ 371 (c)(1),
(2), (4) Date: Jun. 8, 2001

(87) PCT Pub. No.: WO00/34150

PCT Pub. Date: Jun. 15, 2000

(30) Foreign Application Priority Data

Dec. 10, 1998 (DE) ..... 198 57 118
Dec. 18, 1998 (DE) ..... 198 58 786

(51) Int. Cl.[7] ..... B65D 85/10
(52) U.S. Cl. ..... 229/146; 229/160.1
(58) Field of Search ..... 229/146, 160.1; 206/268, 273

(56) References Cited

U.S. PATENT DOCUMENTS 1,877,955 A * 9/1932 Ottinger ..... 206/268
2,951,626 A * 9/1960 Weiss ..... 229/160.1
5,097,948 A * 3/1992 Campbell ..... 229/146
5,511,722 A * 4/1996 Dixon ..... 229/146
5,788,066 A * 8/1998 Focke et al. ..... 229/160.1
5,845,770 A 12/1998 James et al.
5,921,384 A * 7/1999 Focke et al. ..... 229/160.1
6,360,943 B1 * 3/2002 Focke et al. ..... 229/146

FOREIGN PATENT DOCUMENTS

| | | | |
|---|---|---|---|
| DE | 43 42 836 A1 | | 6/1995 |
| DE | 4403416 A1 | * | 8/1995 |
| DE | 195 45 200 A1 | | 5/1997 |
| EP | 1 174 364 A1 | | 1/2002 |
| FR | 2303720 A1 | * | 10/1976 |
| GB | 2229996 A | * | 10/1990 |
| GB | 2290778 A | * | 1/1996 |
| WO | WO-96/09230 A1 | * | 3/1996 |
| WO | WO 00/05151 | | 2/2000 |

* cited by examiner

*Primary Examiner*—Gary E. Elkins
(74) *Attorney, Agent, or Firm*—Sughrue Mion, PLLC

(57) ABSTRACT

A hinge-lid box for cigarettes has a box part (10) and lid (11). A lid front wall (19) and a box front wall (15) form closing edges which are located opposite each other, specifically a lid closing edge (34) and an opposing closing edge (35). The closing edges (34, 35) are arranged at a distance from each other in such a way that, in the region of a field of view or a gap (40) which assumes different shapes, a sub-area of a collar (28), specifically a collar front wall (29), is visible.

10 Claims, 12 Drawing Sheets

28
31
14
21
11
22
34
27
19
41
20
32
12
14
33
38
29
30
13
42
35
39
15
37
12
36
36
16
10

11
21
22
28
20
34
40
38
39
29
37
35
10
19
15
16
17
36
18
36

28
32
33
35
44
45
36
31
29
15
21
34
27
30
16
19
42
36
36
10
11

34
44
17
36
18
22
19
29
15
28
35
45
10
36

28
33
32
14
21
19
27
34
11
54
53
35
36
12
15
29
20
42
43
57
52
36
10

28
54
22
55
20
56
53
35
36
19
15
18
52
34
16
36

28
32
33
68
35
69
36
41
12
29
15
34
19
16
20
42
57
67
36
41
10
11

21
34
40
35
68
17
36
18
22
19
29
15
28
20
67
69
16
36

BOX WITH A HINGED LID, FOR CIGARETTES

BACKGROUND OF THE INVENTION

The invention relates to a hinge-lid box for cigarettes or the like, having a box part and a lid hinged on a box rear wall, and having a collar anchored in the box part and having a collar front wall and collar side walls, its region projecting out of the box part being enclosed by the lid in the closed position, a lid front wall being bounded by a (lower) lid closing edge and a box front wall of the box part being bounded by an (upper) opposing closing edge.

Conventional hinge-lid boxes are designed in such a way that the transversely oriented lid closing edge rests on the likewise transversely oriented opposing closing edge of the box part when in the closed position. However, a hinge-lid box has already been disclosed which has an oblique lid closing edge and a correspondingly oblique opposing closing edge, there being a spacing between the lid closing edge and the opposing closing edge arranged parallel to the latter, so that a strip-like area of the collar front wall is even visible in the closed position of the lid.

SUMMARY OF THE INVENTION

The invention is based on the object of further developing (cigarette) packs of the hinge-lid type primarily with regard to the shaping of the front side, and also of improving their handling.

In order to achieve this object, the hinge-lid box according to the invention is characterized in that the lid closing edge and the opposing closing edge are arranged at distances from each other which vary over the pack width.

The hinge-lid box according to the invention is therefore designed so that the preferably transversely running lid closing edge and the opposing edge have different contours. This produces different shapes in the region of the front side of the pack, geometrically differently shaped regions of the area of the collar front wall being visible in the closed position of the pack. At least this region of the collar front wall can be configured ornamentally or graphically, or can also contain information for the user.

The distance between the lid closing edge and opposing closing edge ensures easier handling when opening, specifically when lifting, the lid. The gap formed between the two closing edges does not, according to the invention, have to extend over the complete width of the hinge-lid box, but can be formed in a central or laterally offset region. Outside the gap, the lid closing edge and opposing closing edge can rest on each other in the conventional way or with a particular coinciding contour.

The configuration of the hinge-lid box according to the invention, specifically with regard to the contour of the lid closing edge and the opposing closing edge, can advantageously be combined with a further configuration feature, specifically with a round-edge pack or oblique-edge pack, that is to say with hinge-lid boxes in which the upright pack edges have a rounded or bevelled cross section, at least in the region of the front side.

BRIEF DESCRIPTION OF THE DRAWINGS

Further details about the configuration of the hinge-lid boxes will be explained below using exemplary embodiments which are illustrated in the drawings and in which.

DETAILED DESCRIPTION OF THE INVENTION

Figure 2:
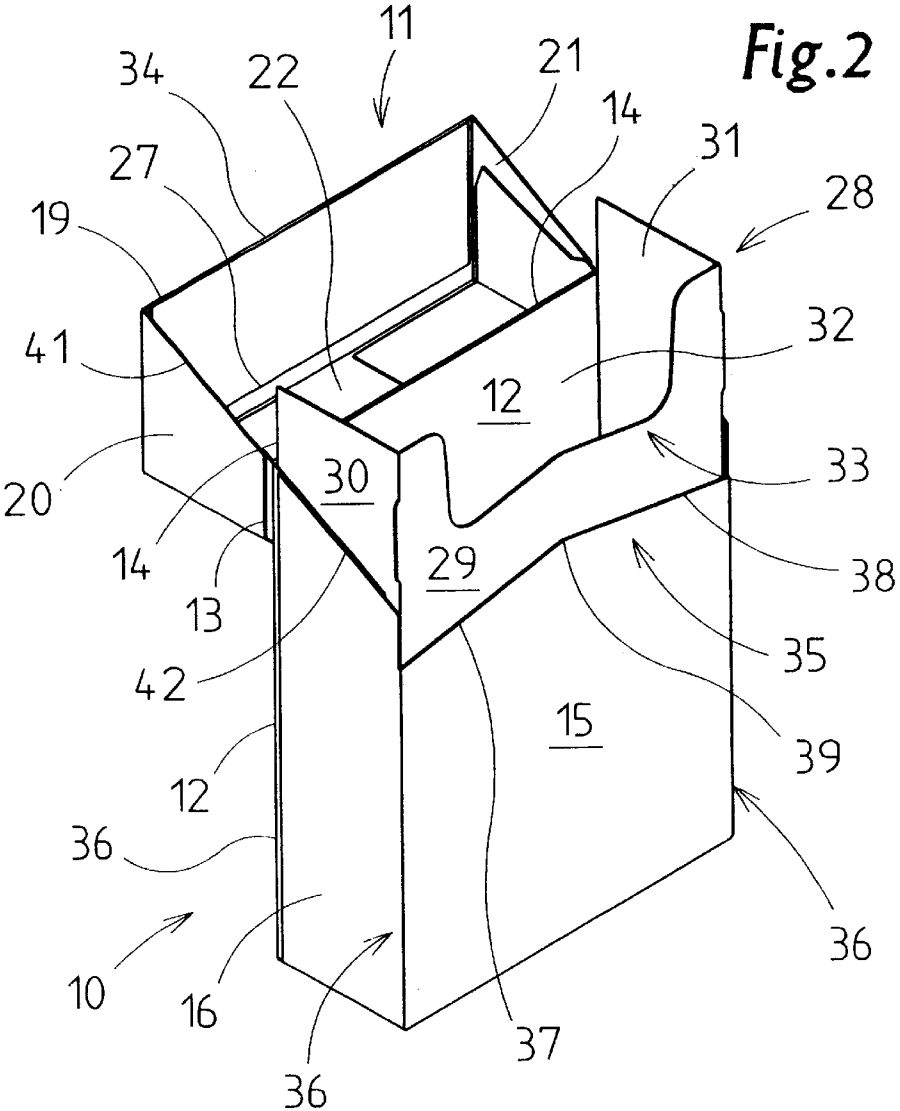
FIG. 2 shows the hinge-lid box according to FIG. 1 in a perspective illustration with the lid open.

Hinge-lid boxes comprise a (lower) box part 10 and an (upper) lid 11 connected to the latter. Box part 10 and lid 11 are connected to each other firstly in the area of a box rear wall 12 and secondly in the area of a lid rear wall 13, via a transversely oriented hinge 14. The box part 10 further comprises a box front wall 15 and box side walls 16, 17. The lower closure of the box parts 10 is a bottom wall 18.

In a way similar to this, the lid 11 comprises a lid front wall 19, lid side walls 20, 21 and an end wall 22.

The box side walls 16, 17 and, in a corresponding way, the lid side walls 20, 21 comprise side tabs 23, 24 which overlap one another wholly or partially and, respectively, of lid side tabs 25, 26. Mutually associated side tabs are connected to each other by adhesive bonding. In addition, in most exemplary embodiments of hinge-lid boxes, a lid inner tab 27 is provided. The latter is connected to a free edge of the lid front wall 17 and is folded over against the inside of the same and fixed to it.

Figure 9:
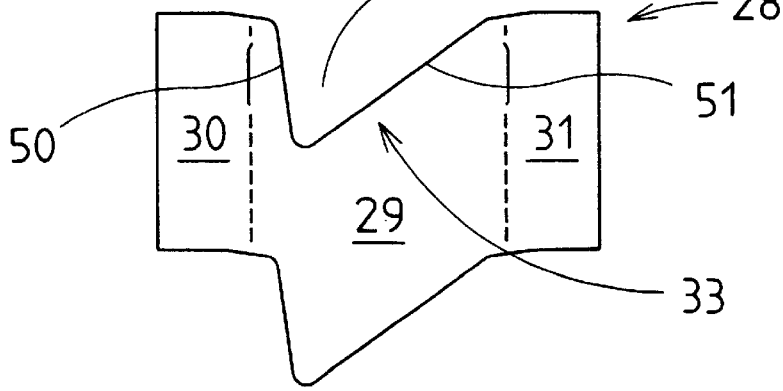
FIG. 9 shows a blank for a collar for the aforementioned pack.

A classically constructed hinge-lid box further includes a collar 28. This comprises a separate blank (e.g. FIG. 9). The collar 28 comprises a collar front wall 29 and collar side walls 30, 31. In the area of the collar front wall 29 there is a cut-out 32 open at the top. This cut-out is bounded by an approximately U-shaped collar edge 33.

One special feature of the present hinge-lid boxes is the configuration of closing edges of the box part 10, on the one hand, and of the lid 11, on the other hand. The lid front wall 19 forms a lid closing edge 34 with its lower edge. If a lid inner tab 27 is present (e.g. FIG. 1, FIG. 2), this lid closing edge 34 is formed by a folded edge of the lid inner tab 27 and the lid front wall 19.

In conventional hinge-lid boxes, when the lid 11 is closed, the lid closing edge 34 rests on an opposing closing edge 35, which is formed by an upper edge of the box front wall 15. The present hinge-lid boxes are constructed in such a way that the lid closing edge 34 rests on the opposing closing edge 35 only in some areas or over the entire width with a possibly variable distance from the opposing closing edge 35.

Figure 1:
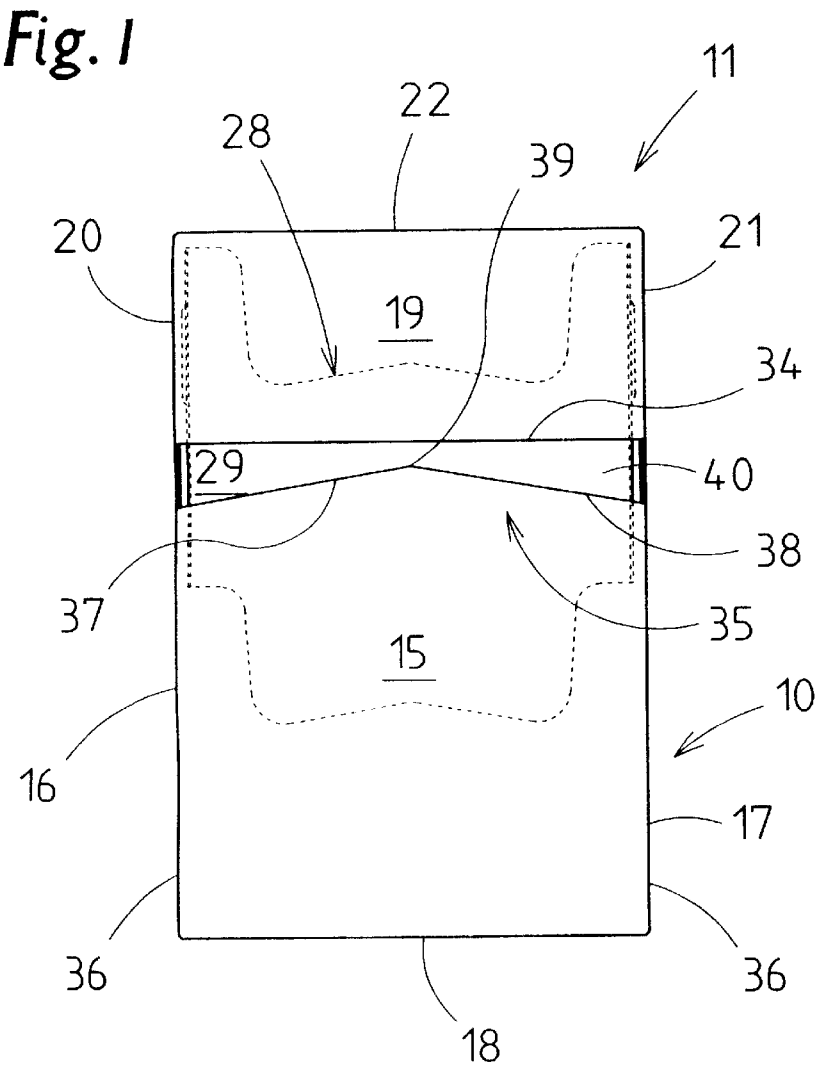
FIG. 1 shows a hinge-lid box in front view with the lid closed.
Figure 3:
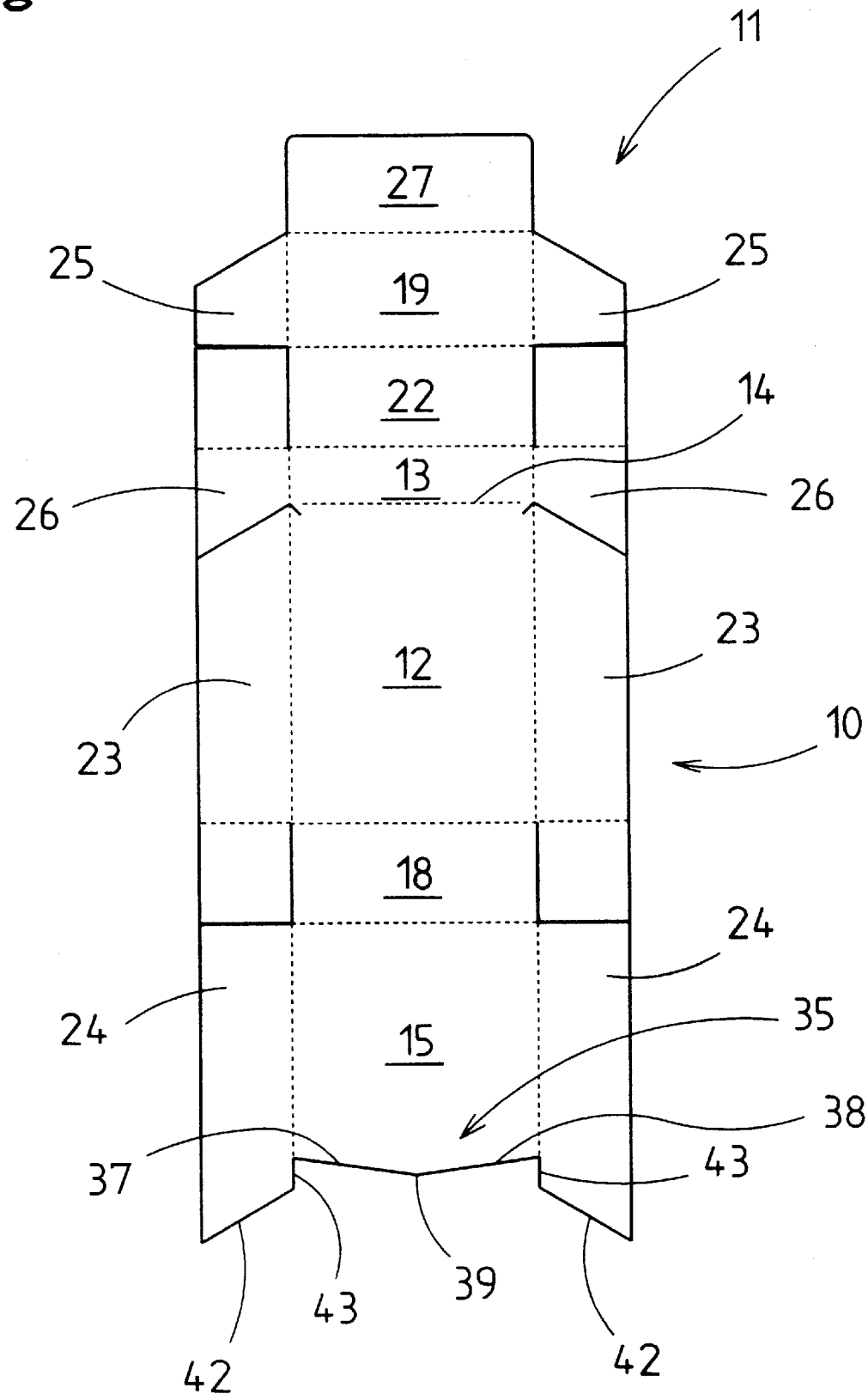
FIG. 3 shows a spread-out, unfolded blank for a hinge-lid box according to FIG. 1 and FIG. 2.

In the exemplary embodiment according to FIGS. 1 to 3, the lid closing edge 34 is oriented horizontally or transversely at right angles to upright pack edges 36.

The opposing closing edge 35 of the box part 10 has a different contour, is of V-shaped design, specifically with two edge limbs 37, 38 running towards each other at an obtuse angle. In the present case, these run together centrally in an elevation or point 39. The opposing closing edge 35 is arranged overall at a distinct distance from the lid closing edge 34, in such a way that a gap 40 extending over the full width of the pack front side is formed. In this area, when the pack is closed (FIG. 1) one sub-area of the collar front wall 29 is visible, to be specific in a geometric shape determined by the shape of the closing edges. At least in this area, the collar front wall 29 may be decorative or have informative printing.

Closing edges are also formed in the region of the pack side walls, to be specific in a shape which rises obliquely towards the pack rear side. In this case, these are oblique edges 41 as lower boundaries of the lid side walls, 20, 21, and correspondingly arranged oblique edges 42 as upper boundaries of the box side walls 16, 17. When the lid 11 is closed, the oblique edges 41, 42 lie on each other.

The blank (FIG. 3) for a pack designed in this way is shaped accordingly. The box front wall 15 is bounded at the free end of the blank by the angled opposing closing edge 35. In the area of the pack edges 36, this merges into a longitudinal edge 43 running in the direction of the pack edges 36. This is followed by the respective oblique edge 42 of the outer side tab 24.

The collar or the collar front wall 29 is matched to the contour of the opposing closing edge 35, specifically is likewise angularly shaped, so that regions of the collar edge 33 run approximately parallel to the opposing closing edge 35.

Figure 5:
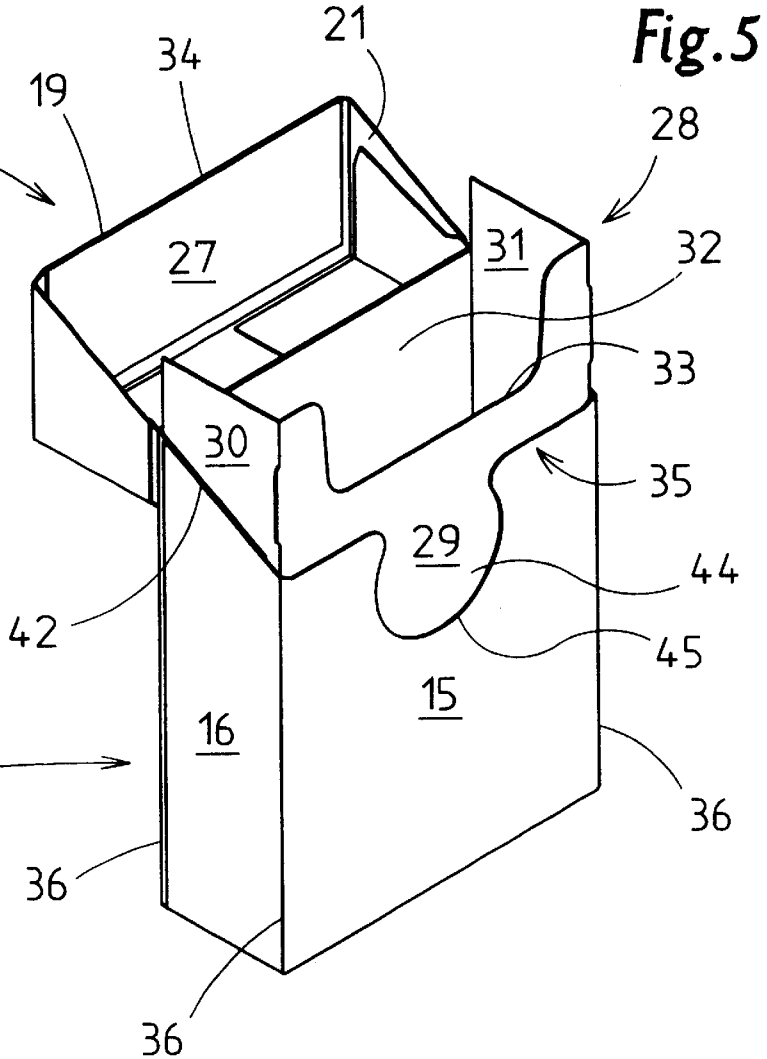
FIG. 5 shows the hinge-lid box according to FIG. 4 in a perspective illustration with the lid open.
Figure 4:
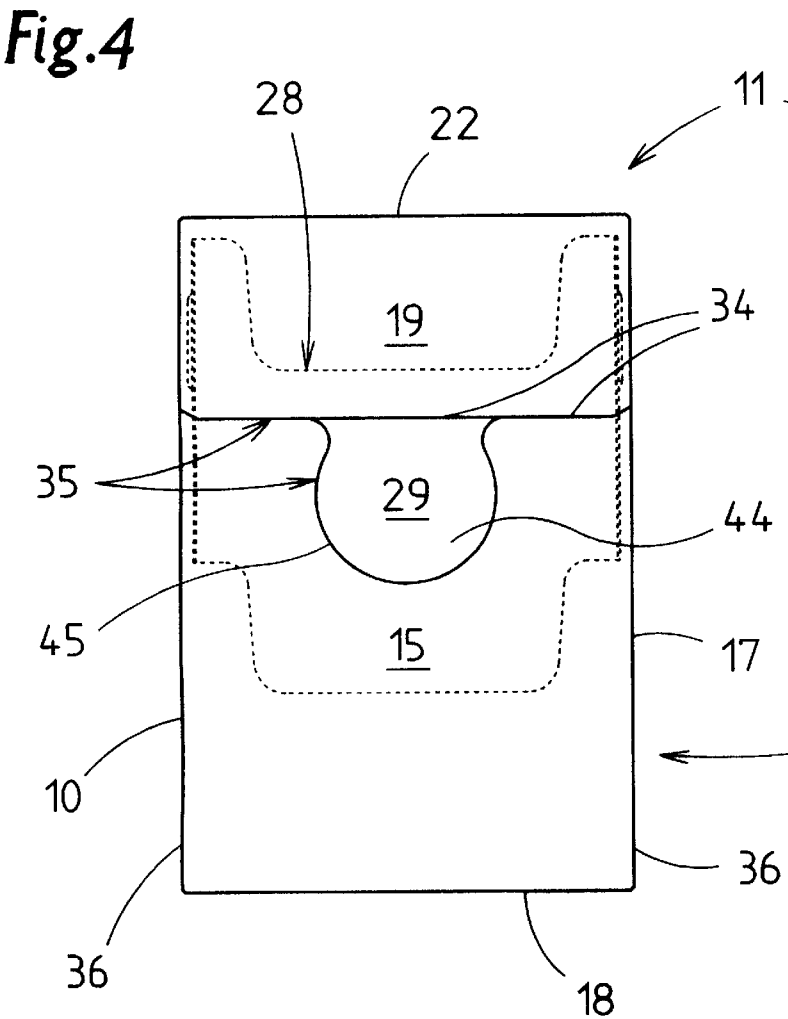
FIG. 4 shows another exemplary embodiment of a hinge-lid box in an illustration corresponding to FIG. 1.
Figure 7:
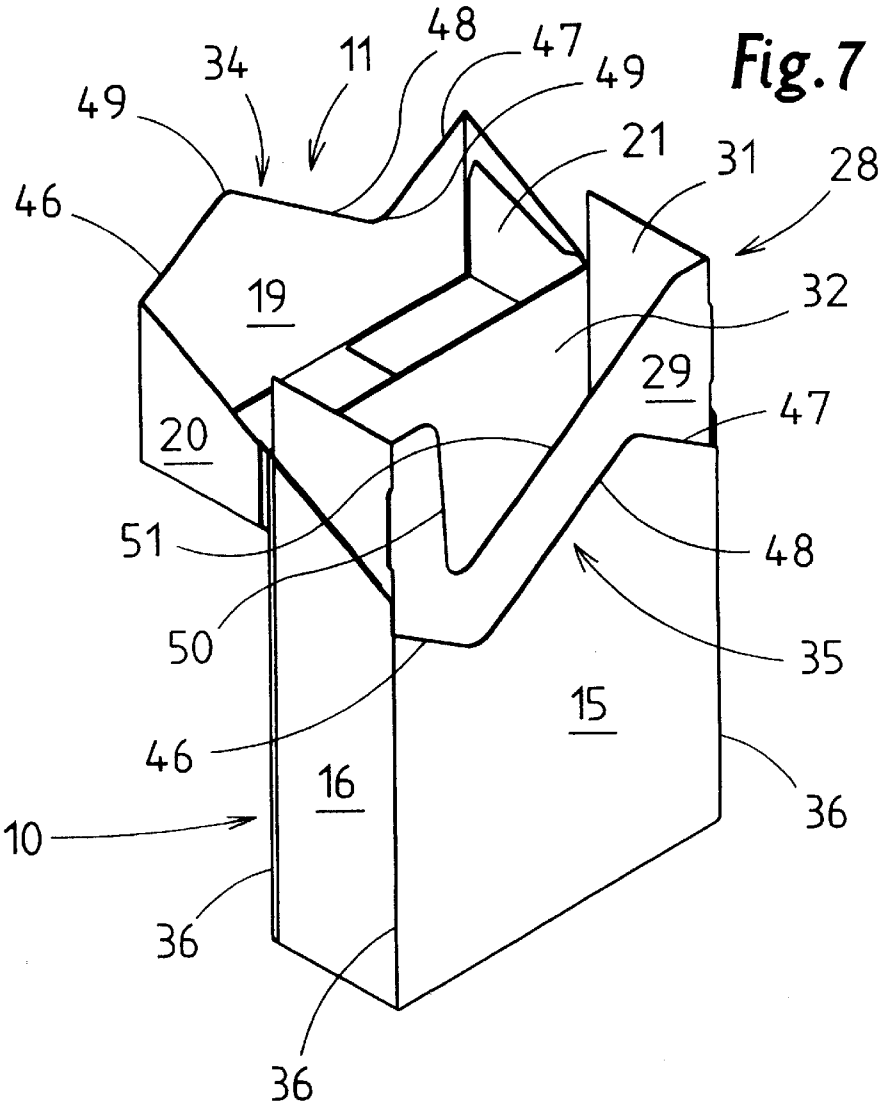
FIG. 7 shows the hinge-lid box according to FIG. 6 in a perspective illustration with the lid open.
Figure 6:
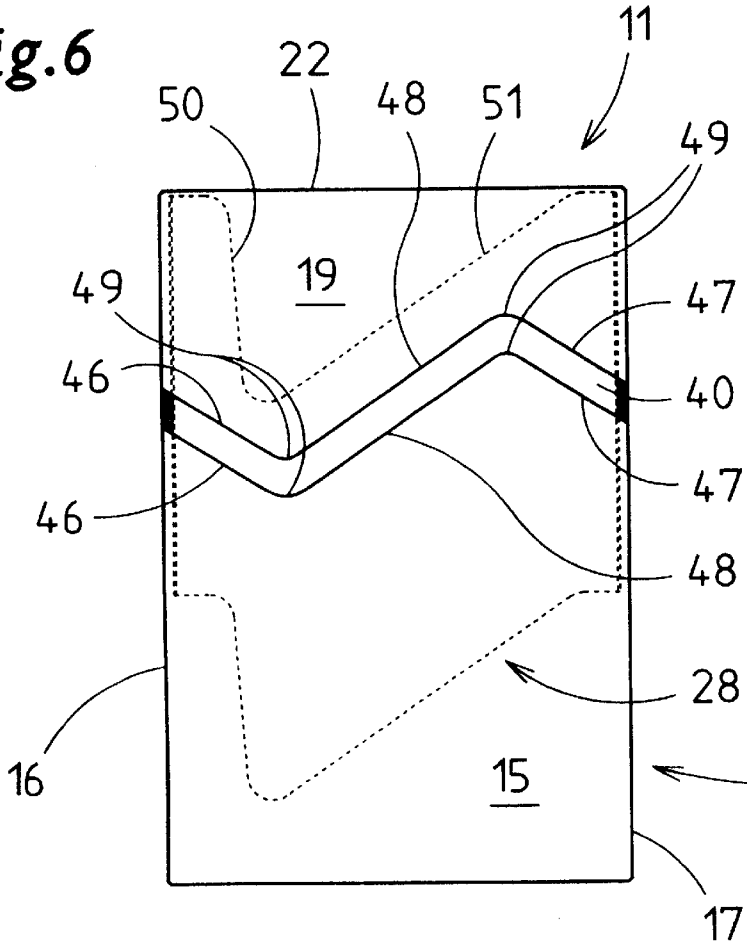
FIG. 6 shows a further exemplary embodiment of a hinge-lid box in front view.
Figure 8:
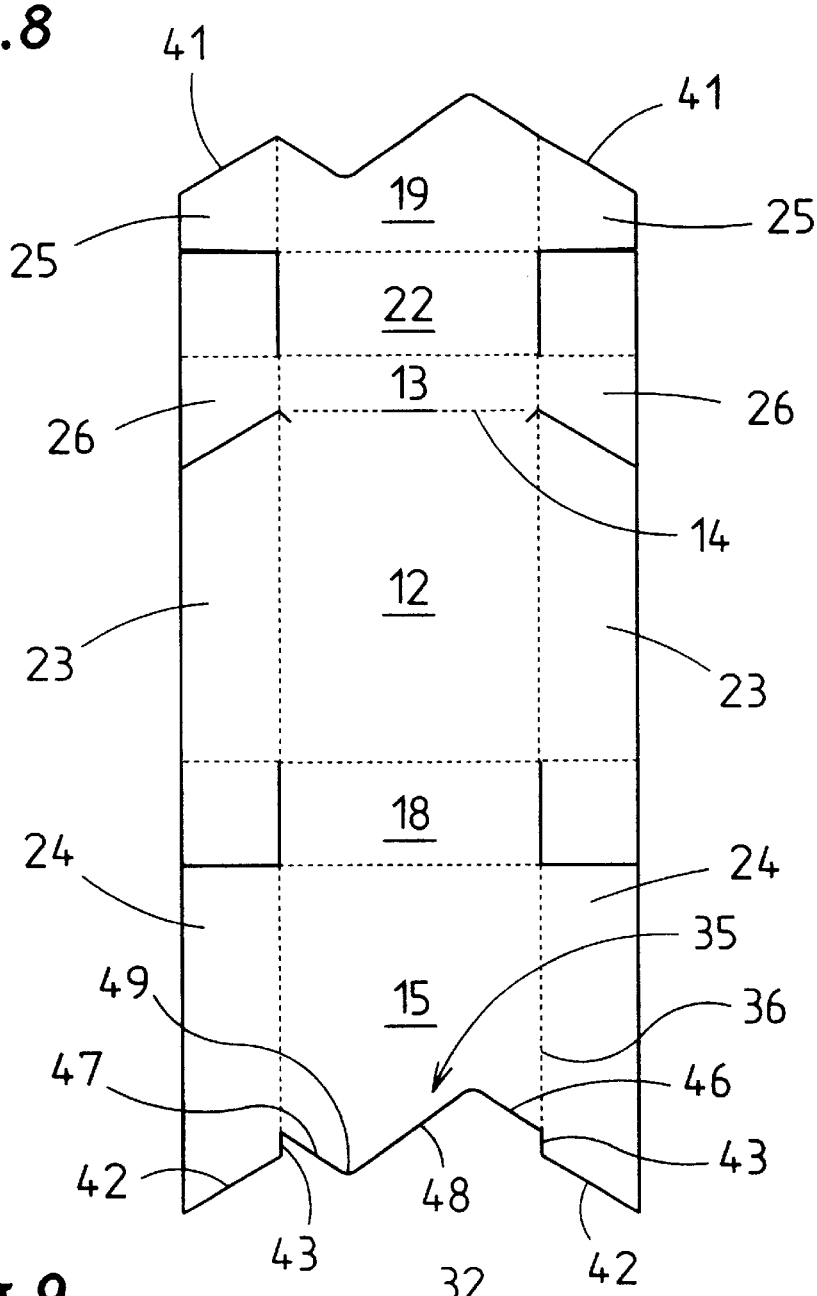
FIG. 8 shows a spread-out, unfolded blank for a hinge-lid box according to FIG. 6 and FIG. 7.

In their fundamental construction, the hinge-lid boxes according to FIG. 4 and FIG. 5 likewise correspond to a conventional hinge-lid box. As in the present exemplary embodiment, the lid closing edge 34 is of rectilinear shape and runs transversely with respect to the rectangular pack edges 36.

Designed in a particular way is the opposing closing edge 35 as the upper boundary of the box front wall 15. In the central area of the box front wall 15, a depression 44 is formed. This depression is bounded by a circular or partly circular section 45 of the opposing closing edge 35. When the hinge-lid box is closed (FIG. 4), a field of view, with an approximately circular area, of the collar front wall 29 can be seen on the front. This field is bounded on one side by the section 45 of the opposing closing edge 35 and on the other side by the transverse lid closing edge 34.

In this exemplary embodiment, the collar 28 is formed in the conventional way. In addition, the blank for this pack in principle corresponds to a conventional blank for this pack type, only the depression 44 having to be formed by appropriate stamping in the area of the box front wall 15.

In the hinge-lid box according to FIG. 6 to FIG. 9, a distinction from the previous configuration principle is provided in as much as the lid closing edge 34 also has a special contour, specifically wavy or zigzag-like in the present case. The lid closing edge 34 comprises two side limbs 46, 47 and a central section 48. All the regions of the lid closing edge 34 run obliquely, that is to say at an angle to the pack edges 36. One side limb 46—starting from the pack edge 36—is oriented obliquely downwards. Its centre section 48 adjoining this is oriented obliquely upwards, and the other side limb 47 is designed to fall obliquely in the direction of the pack edge 36. Round curves 49 are provided as a transition between the edge sections.

The opposing closing edge 35 of the box front wall 15 is formed in a similar way, and therefore runs overall parallel to the lid closing edge 34, but at a distinct distance. Accordingly, the opposing closing edge 35 also forms side limbs 46, 47 and a central section 48. In this way, a zigzag-like or wavy form of the gap 40 is created, with a corresponding visible region of the area of the collar front wall 29. The blank (FIG. 8) for this pack form is designed accordingly. As distinct from the preceding exemplary embodiments, there is no lid inner tab. Instead, the lid front wall 19 forms the lid closing edge 34 directly and in one layer, the said lid closing edge 34 being formed in the manner described. The side limbs 46, 47 merge into the oblique edges 41 of the lid side walls 20, 21.

The opposite end of the blank is designed correspondingly in the area of the box front wall 15, specifically with the opposing closing edge 35. This is adjoined by the longitudinal edges 43, which merge into the oblique edges 42.

The collar 28 (FIG. 9) is also formed in a particular way. The collar front wall 29 has a cut-out 32 which is arranged asymmetrically, specifically offset to the side, and which is bounded by two edge regions 50, 51 running towards each other at an acute angle. In this case, the collar 28 is arranged and shaped in such a way that the edge region 51 of the collar edge 33 runs parallel to the central section 48 of the opposing closing edge 35.

Figure 11:
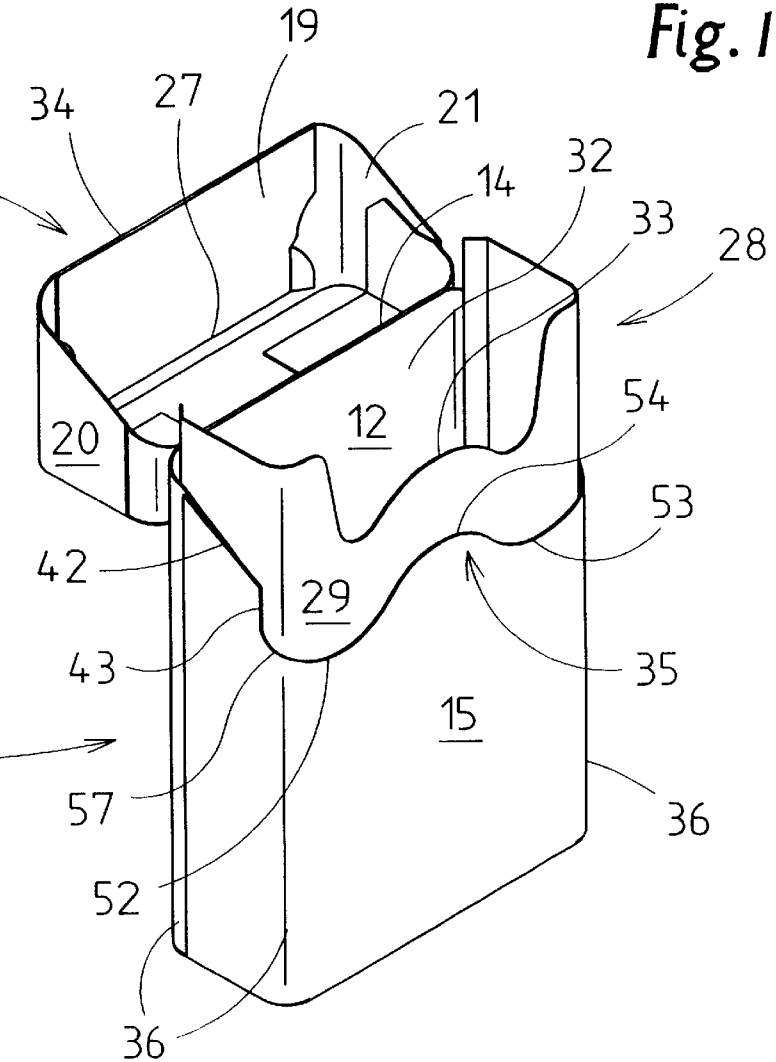
FIG. 11 shows the hinge-lid box according to FIG. 10 in a perspective illustration with the lid open.
Figure 10:
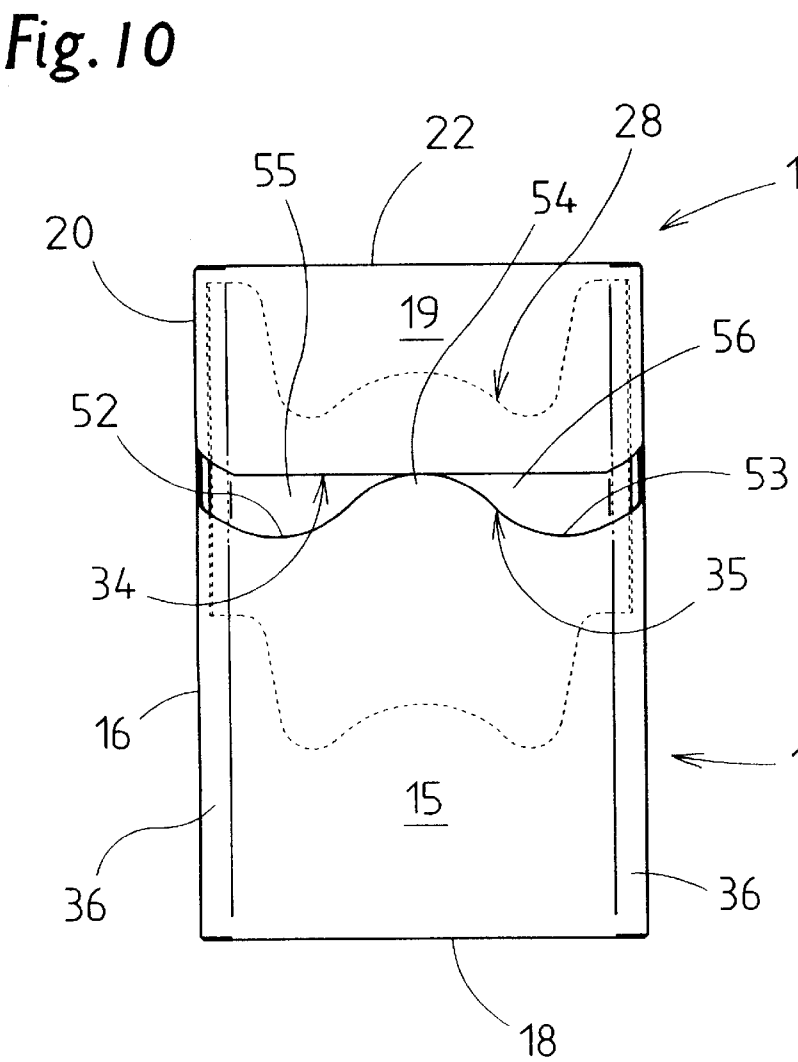
FIG. 10 shows a fourth exemplary embodiment of a closed hinge-lid box in front view.

In the hinge-lid box according to FIG. 10 and FIG. 11, the opposing closing edge 35 of the box front wall 15 is designed to be wavy with two lateral depressions 52, 53 and a central or centrally arranged curved elevation 54. The transversely oriented, rectilinear lid closing edge 34 rests on the elevation 54 of the opposing closing edge 35 in the closed position (FIG. 10). This produces two lateral fields of view 55, 56, in the area of which the collar front wall 29 can be seen.

The above-described configuration of the closing edges is applied in a hinge-lid box having round edges, that is to say with upright pack edges 36 which have a rounded, circular cross section, corresponding to the dimensions of a cigarette. In this case, the opposing closing edge 35 extends as far as the region of the round edges or as far as a boundary of the round edges which faces the box side walls 16, 17 (FIG. 11). The opposing closing edge 35 forms rounded portions 57 here, which are followed by upright longitudinal edges 43.

The collar 28 is designed accordingly, specifically with a collar edge 33 running in a wave shape. The contour is matched to the shape of the opposing closing edge 35, that is to say with a central, wavy elevation.

Figure 13:
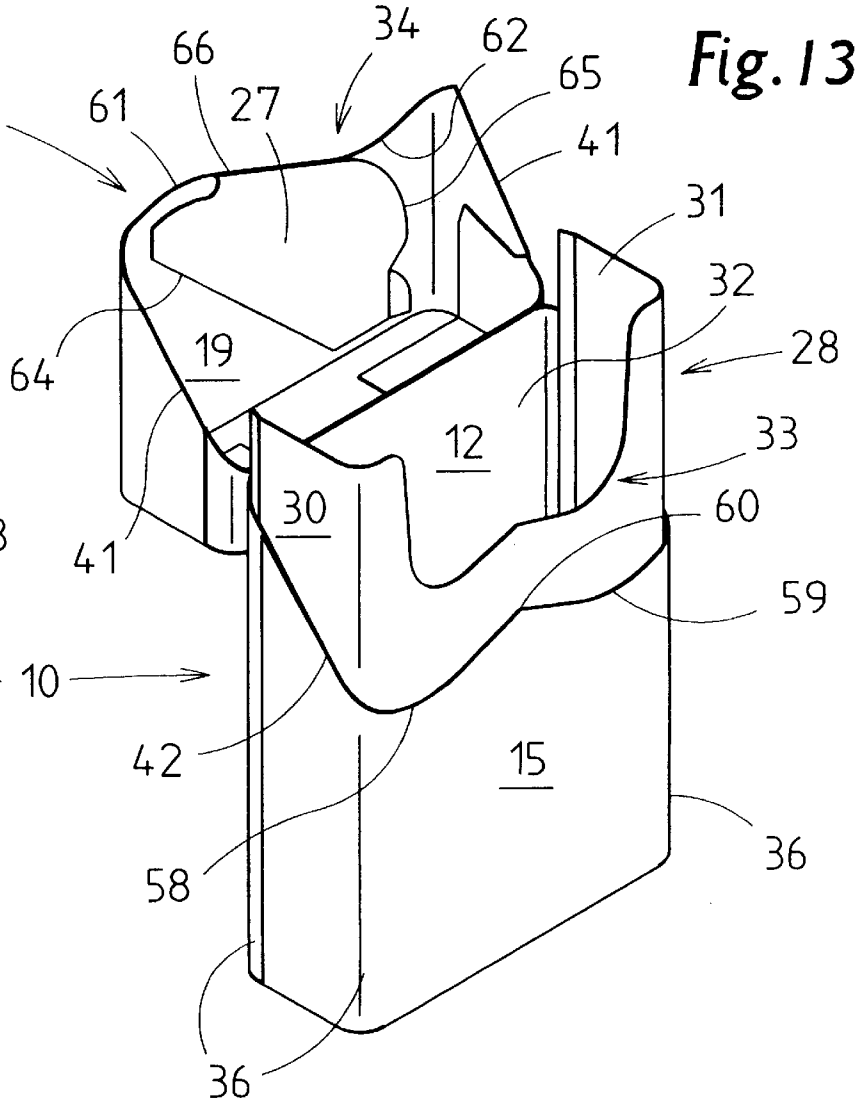
FIG. 13 shows the hinge-lid box according to FIG. 12 in a perspective illustration with the lid open.
Figure 12:
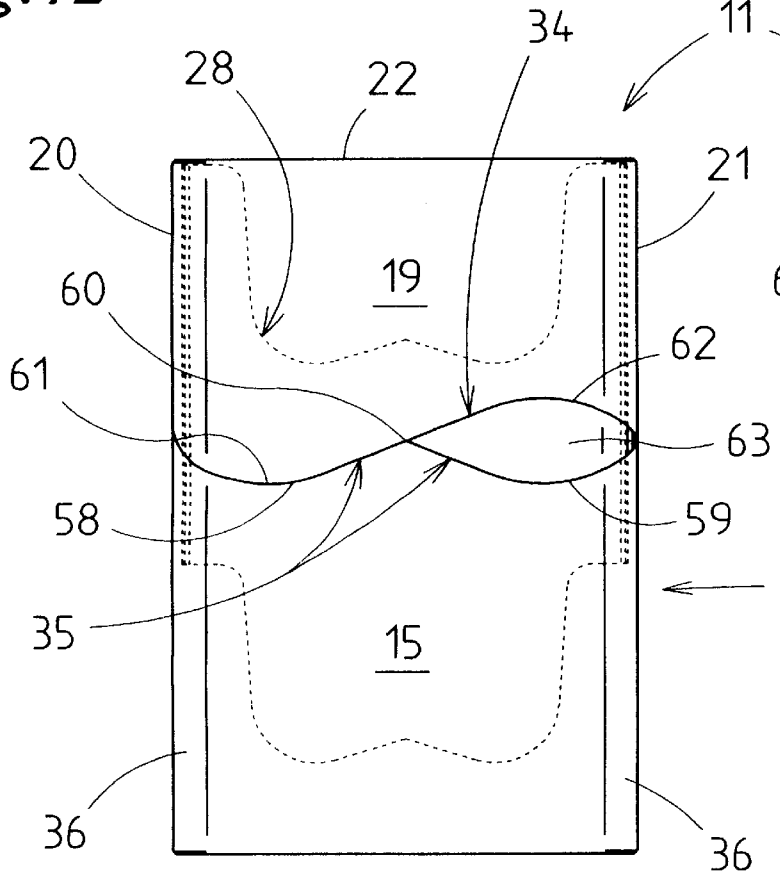
FIG. 12 shows a fifth exemplary embodiment of a hinge-lid box in front view with the lid closed.
Figure 14:
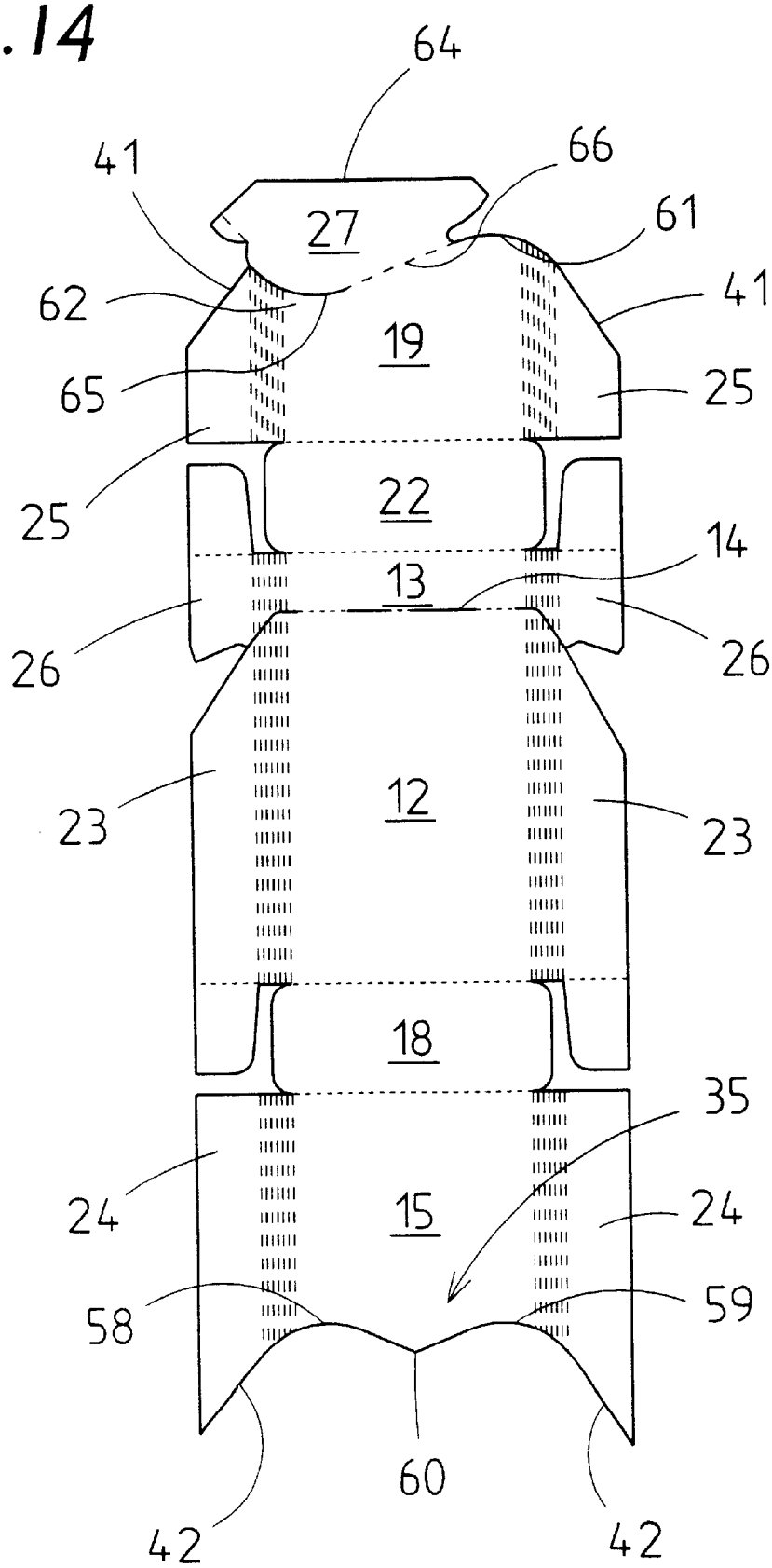
FIG. 14 shows the spread-out blank for a hinge-lid box according to FIG. 12 and FIG. 13.

The hinge-lid box according to FIG. 12 to FIG. 14 also relates to a round-edge pack, that is to say a hinge-lid box with rounded pack edges 36. The opposing closing edge 35 forms two curved edge sections 58, 59, which run together centrally in a point 60 oriented upwards. At the edges, the edge sections 58, 59 merge into the oblique edges 42 without any step, that is to say in a curve.

The lid front wall 19 is configured in a particular way. The lid closing edge 34 is approximately S-shaped with a downwardly oriented convexity 61 and an opposite convexity 62 running upwards. The convexity 61 running downwards is dimensioned and shaped in such a way that it corresponds with the corresponding part of the opposing closing edge 35. The convexity 61 enters the region of the box front wall 15 with a form fit in such a way that the convexity 61 rests on the edge section 58 of the opposing closing edge 35. On the opposite side, an approximately oval field of view 63 is produced off-centre. In this region, the collar front wall 29 is visible.

The lid 11 or the lid front wall 19 is provided with a lid inner tab 27. The latter is provided at the free edge (blank according to FIG. 14) with a transversely oriented, rectilinear marginal edge 64. On the side facing the lid front wall 19, the lid inner tab 27 is contoured in a wave shape corresponding to the lid closing edge 34. A subsection of the connection between lid inner tab 27 and lid front wall 19 is designed as a curved severing cut 65. Another region (dashed in FIG. 14) forms a folding edge 66. In the folded position (FIG. 13), the lid inner tab 27 is located in an oblique position or with the marginal edge 64 oriented obliquely.

With regard to the collar edge 33, the collar 28 is also adapted to the contour of the opposing closing edge 35 in this exemplary embodiment.

Figures 15, 16:
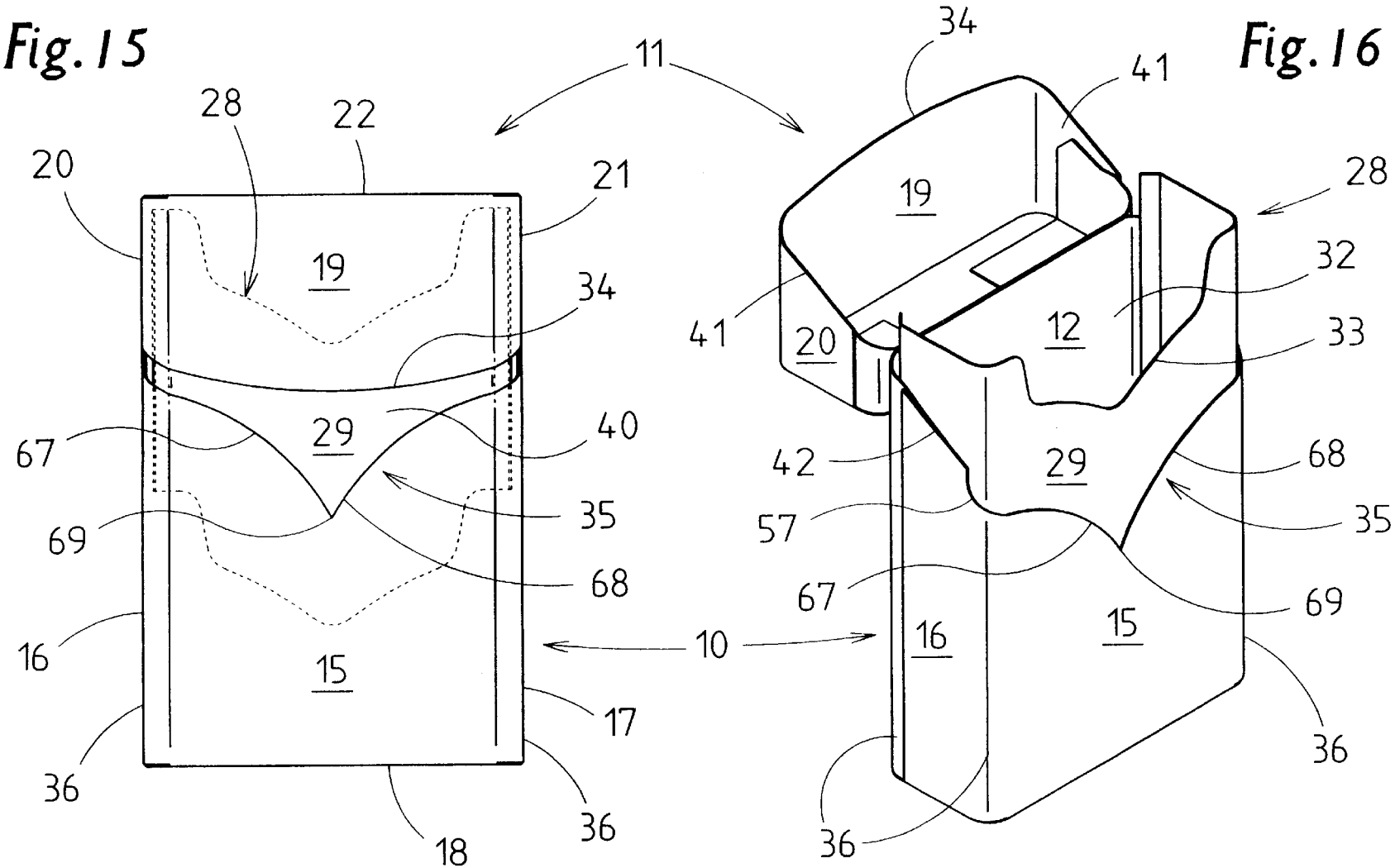
FIG. 15 shows a sixth embodiment of a hinge-lid box with lid closed in front view.
FIG. 16 shows the hinge-lid box according to FIG. 15 in a perspective illustration with the lid open.
Figure 17:
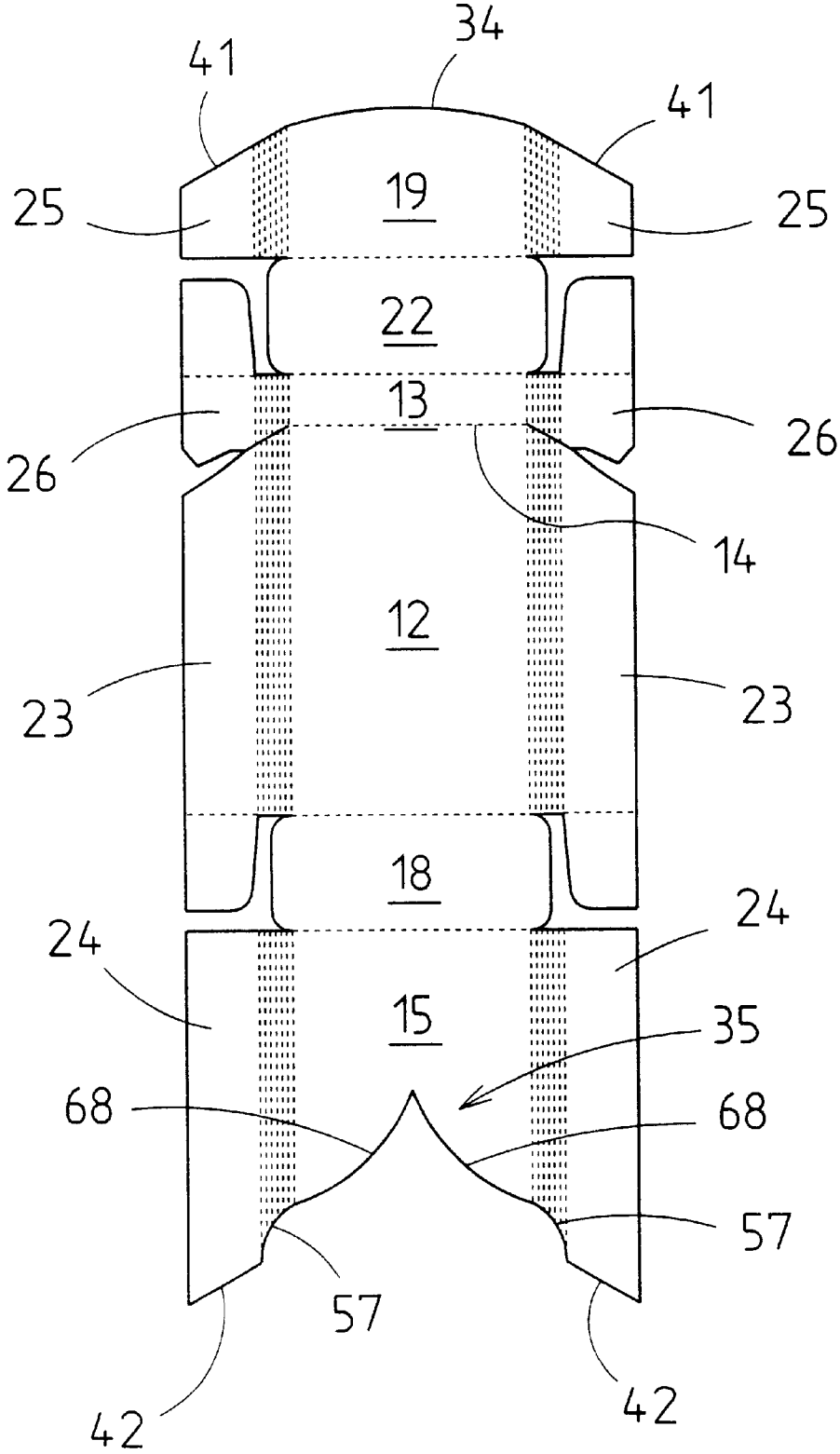
FIG. 17 shows a spread-out blank for a hinge-lid box according to FIG. 15 and FIG. 16.
Figure 19:
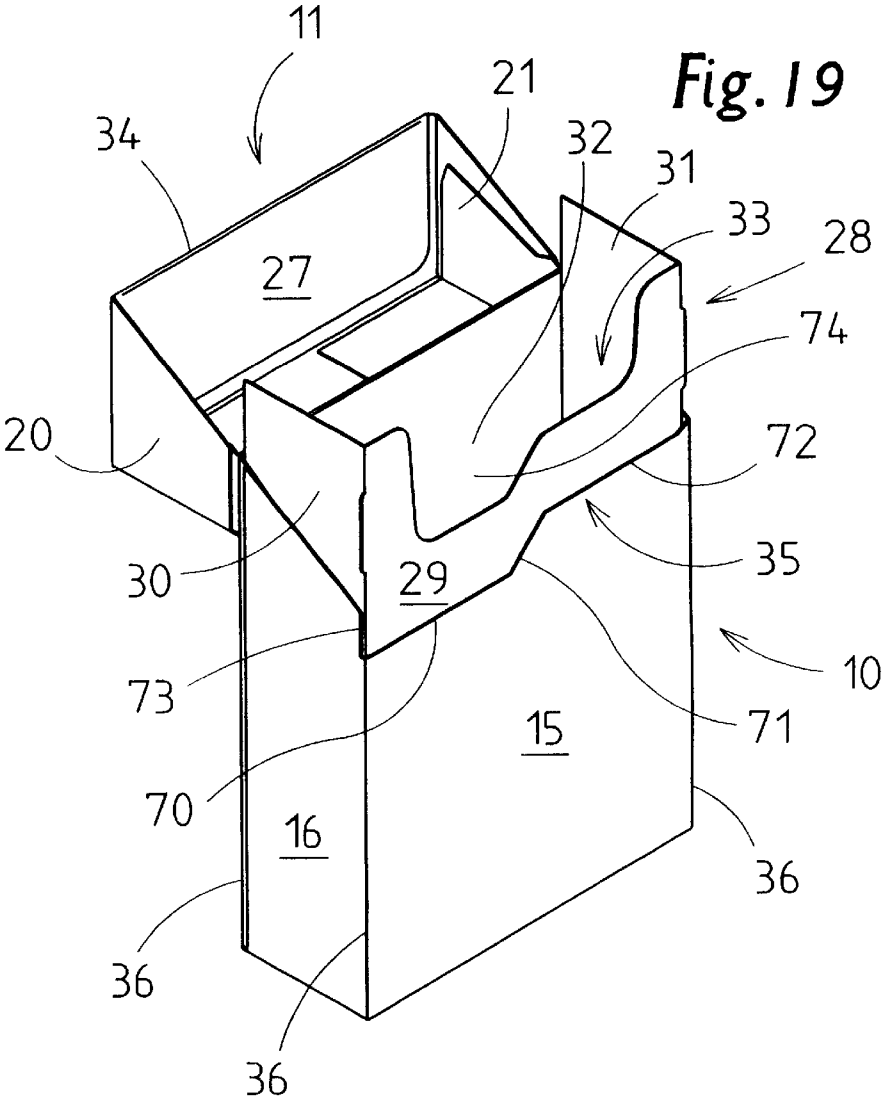
FIG. 19 shows the hinge-lid box according to FIG. 18 in a perspective illustration with the lid open.
Figure 18:
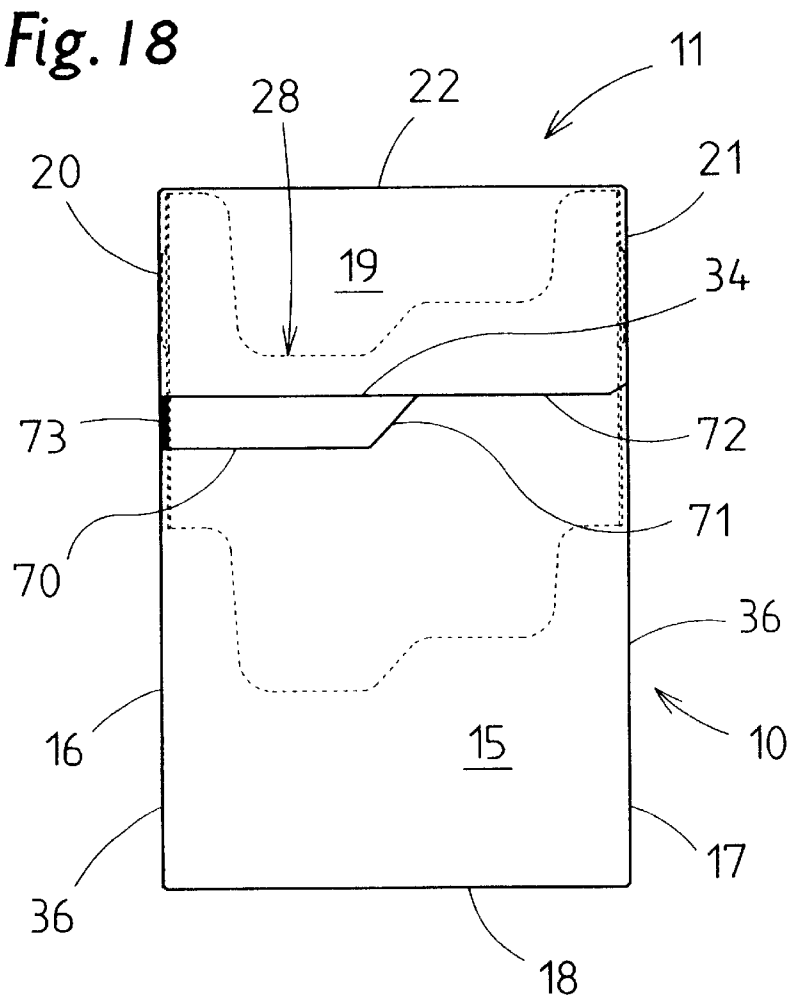
FIG. 18 shows a seventh exemplary embodiment of a hinge-lid box in front view.
Figure 20:
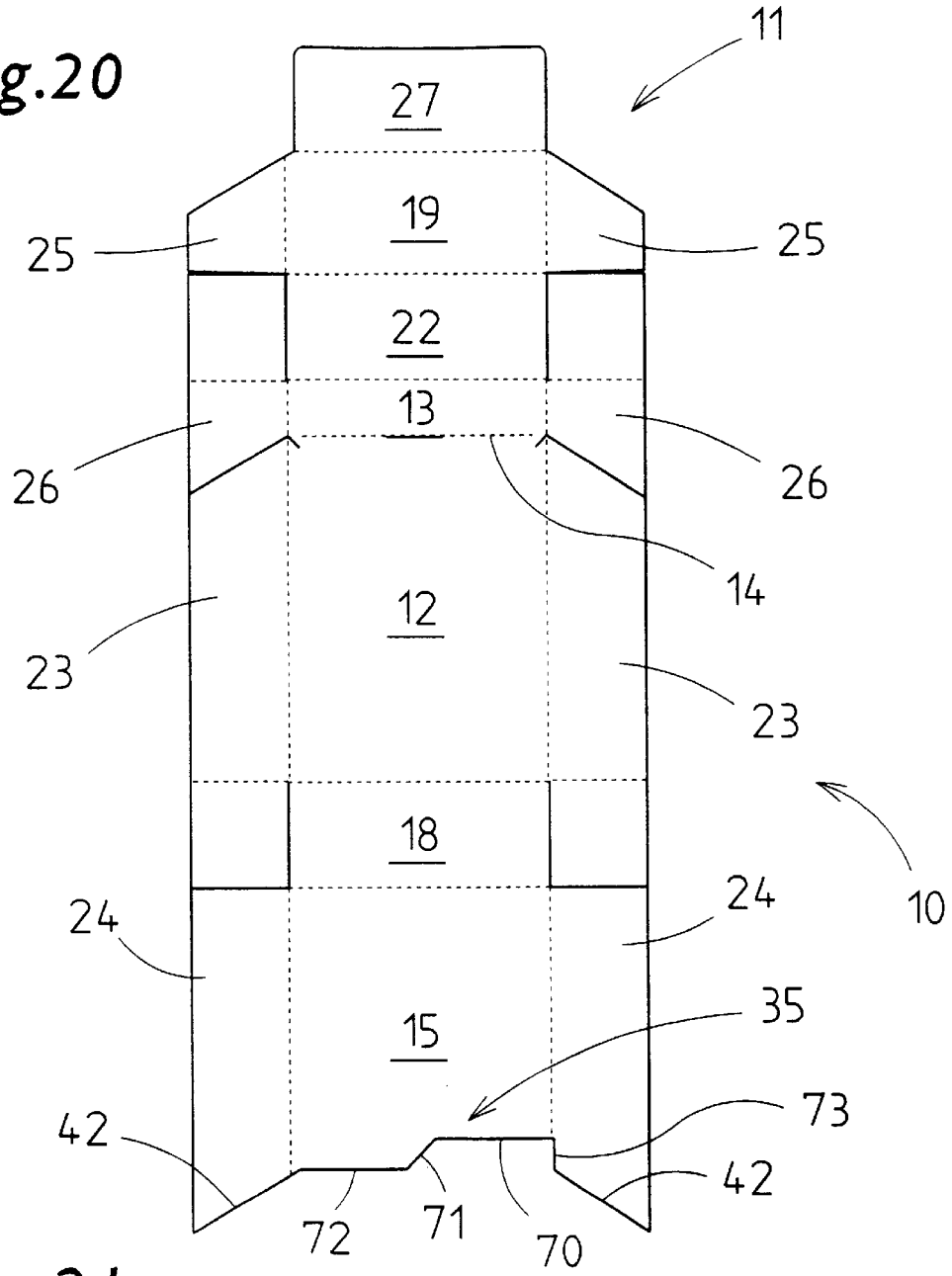
FIG. 20 shows the spread-out blank of the hinge-lid box according to FIG. 18 and FIG. 19.
Figure 21:
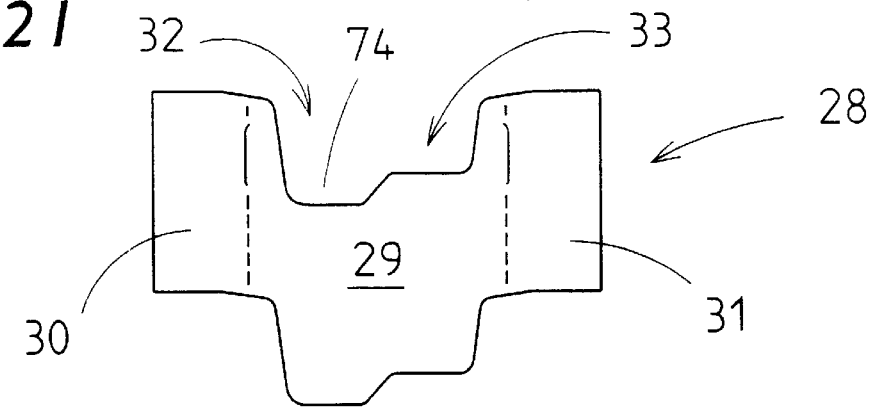
FIG. 21 shows a spread-out blank of a collar for a hinge-lid box according to FIG. 18 and FIG. 19.

FIG. 15 to FIG. 17 also show details of a hinge-lid box with rounded pack edges 36. The opposing closing edge 35 on the box front wall 15 has a contour with two rounded edge sections 67 and 68. These run together centrally in a point 69 pointing downwards. At the edges and in the region of the box side walls 16, 17, the edge sections 67, 68 merge into the oblique edges 42 with rounded portions 57.

The lid front wall 19 (without lid inner tabs) has a curved lid closing edge 34. The latter runs over the full width of the pack front side at a distance from the opposing closing edge 35. A field of view or a gap 40 is therefore produced, extending over the complete width of the pack.

FIG. 18 to FIG. 21 concern details of a hinge-lid box which is suitable for round or bevelled pack edges 36, but in the present case has conventional pack edges 36 with a rectangular cross section. The lid closing edge 34 and opposing closing edge 35 rest on each other or are immediately opposite each other in one sub-area. In another sub-area of the pack width, the closing edges 34, 35 run at a distance from each other, so that a gap 40 is produced, which extends only over a sub-area of the front side of the hinge-lid box.

In the exemplary embodiment shown, the lid overall is formed in a conventional way, specifically with (rectangular) lid inner tabs 27 and rectilinear lid closing edge 34 oriented transversely with respect to the pack edges 36. In addition, the opposing edge 35 here comprises only rectilinear part-edges, which run parallel to the lid closing edge 34. In this case, this is a first, marginal (left-hand) part-edge 70. This runs at a distance from the lid closing edge 34. A transitional edge 71 adjoins the part-edge 70 approximately centrally with an oblique course as far as a second part-edge 72. The latter extends in a different (right-hand) sub-area of the pack front side, to be specific parallel to the part-edge 70, but offset in such a way that, in this area, the lid closing edge 34 and opposing closing edge 35 rest on each other when the lid 11 is closed. The gap 40 formed in this way extends over a sub-area of the front side, specifically approximately as far as the centre.

In the area of the box side wall 16, the part-edge 70 merges via a connecting edge 73 into the oblique edge 42 of the side tab 24. The connecting edge 73 extends in the relevant pack edge 36. On the opposite side, the part-edge 72 merges directly in a conventional way into the corresponding oblique edge 42.

The collar 28 is also shaped in a particular way, namely being adapted to the contour of the opposing closing edge 35. Accordingly, the collar edge 33 comprises two mutually offset part-edges and a transitional edge, substantially parallel to the contour of the opposing closing edge 35. To make the removal of cigarettes easier, the cut-out 32 in the region of the collar front wall 29 is shaped in such a way that to one side (on the left) a depression 74 is formed, which opens a larger area of the cigarettes when the lid 11 is open.

List of Reference Symbols

| | |
|---|---|
| 10 | Box part |
| 11 | Lid |
| 12 | Box rear wall |
| 13 | Lid rear wall |
| 14 | Hinge |
| 15 | Box front wall |
| 16 | Box side wall |
| 17 | Box side wall |
| 18 | Bottom wall |
| 19 | Lid front wall |
| 20 | Lid side wall |
| 21 | Lid side wall |
| 22 | End wall |
| 23 | Side tab |
| 24 | Side tab |
| 25 | Lid side tab |
| 26 | Lid side tab |
| 27 | Lid inner tab |
| 28 | Collar |
| 29 | Collar front wall |
| 30 | Collar side wall |
| 31 | Collar side wall |
| 32 | Cut-out |
| 33 | Collar edge |
| 34 | Lid closing edge |
| 35 | Opposing closing edge |
| 36 | Pack edge |
| 37 | Edge limb |
| 38 | Edge limb |
| 39 | Point |
| 40 | Gap |
| 41 | Oblique edge |
| 42 | Oblique edge |
| 43 | Longitudinal edge |
| 44 | Depression |
| 45 | Section |
| 46 | Side limb |
| 47 | Side limb |
| 48 | Central section |
| 49 | Round curve |
| 50 | Edge region |
| 51 | Edge region |
| 52 | Depression |

-continued

| | |
|---|---|
| 53 | Depression |
| 54 | Elevation |
| 55 | Field of view |
| 56 | Field of view |
| 57 | Rounded portion |
| 58 | Edge section |
| 59 | Edge section |
| 60 | Point |
| 61 | Convexity |
| 62 | Convexity |
| 63 | Field of view |
| 64 | Marginal edge |
| 65 | Severing cut |
| 66 | Folding edge |
| 67 | Edge section |
| 68 | Edge section |
| 69 | Point |
| 70 | Part-edge |
| 71 | Transitional edge |
| 72 | Part-edge |
| 73 | Connecting edge |
| 74 | Depression |

What is claimed is:

1. A hinge-lid box for cigarettes, comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening, the lid closing edge (34) has a continuously rectilinear course oriented transversely with respect to upright pack edges (36), the lid closing edge (34) is a folding edge between the lid front wall (19) and a lid inner tab (27) resting on the inside of the said lid front wall (19), and the opposing closing edge (35) has a course which differs from the lid closing edge (34), specifically being curved or angled.

2. The hinge-lid box according to claim 1, characterized in that at least one of the closing edges is wavy, zigzag-shaped or V-shaped, with at least two edge limbs (37, 38) arranged at an angle to each other, and in that the other closing edge (34) has a rectilinear course which is oriented transversely at right angles to the pack edges (36).

3. A hinge-lid box for cigarettes, comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening, in that the opposing closing edge (35) has an upwardly oriented protrusion (54), and in that the lid closing edge (34) is rectilinear and rests on the protrusion when the lid is in the closed position.

4. A hinge-lid box for cigarettes, comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening, the lid closing edge (34) and the opposing closing edge (35) rest on each other in a first off-centre sub-area corresponding to approximately half the width of the box front wall (15) and lid front wall (19) when the lid (11) is in the closed position, and in another off-centre sub-area, the lid closing edge (34) and opposing closing edge (35) run at a distance from each other, forming the opening.

5. The hinge-lid box according to claim 4, characterized in that the opposing closing edge (35) comprises two vertically offset, parallel part-edges (70, 72), which are connected to each other by a transitional edge (71), the higher one of said two part-edges (72) resting on the lid closing edge (34) when the lid (11) is in the closed position, while, in a lateral area, the opening (40) is formed between the lid closing edge (34) and the part-edge (70).

6. A hinge-lid box for cigarettes, comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening;

in that the opposing closing edge (35) is wavy or zigzag-shaped; and in that the lid closing edge (34) is matched to a contour of the opposing closing edge (35) in such a way that a section of the lid closing edge (34) rests with a form fit on a corresponding section of the opposing closing edge (35), specifically on a correspondingly shaped section (58), forming a downwardly oriented convexity (61).

7. A hinge-lid box for cigarettes, comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening;

in that the opposing closing edge (35) comprises two downwardly curved edge sections (67, 68) which run together in a downwardly oriented point (69); and in that the lid closing edge (34) has a curved, convex course with a curvature oriented downwards.

8. A hinge-lid box for cigarettes, comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening;

in that the opposing closing edge (35) forms a depression (44) in a region thereof; and in that the opposing closing edge (35) runs rectilinearly outside a region of the depression (44), the correspondingly designed rectilinear lid closing edge (34) resting on the opposing closing edge (35) outside the depression (44).

9. A hinge-lid box for cigarettes, comprising a box part (10) and a lid (11) hinged on a box rear wall (12), and further comprising a collar (28), with a collar front wall (29) and collar side walls (30, 31), a lid front wall (19) delimited by a lower lid closing edge (34), and a box front wall (15) delimited by an upper opposing closing edge (35), characterized in that:

a) the lid closing edge (34) and the opposing closing edge (35) run parallel to each other and at a distance from one another, b) the lid closing edge (34) and the opposing closing edge (35) run in a zigzag or wavy progression such that an exposed, corresponding zigzag or wavy gap (40) of approximately constant width is created between the lid front wall (19) and the pack front wall (15), and c) the lid closing edge (34) and the opposing closing edge (35) each comprise first and second oblique side limbs (46, 47) and a likewise oblique central section (48), the first side limb (46), proceeding from one upright side pack edge (36), being directed downward, with the central section (48) continuing therefrom in an oblique downward direction, and with the second side limb (47) configured at a downward slant toward another upright side pack edge.

10. The hinge-lid pack according to claim 9, characterized in that the collar (28) has a cut-out (32) in the region of the collar front wall (29), said cut-out (32) being bounded exclusively by two edge regions (50, 51) which meet one another at an acute angle, with one of the edge regions (51) running parallel to the central section (48) of the opposing closing edge (35).

* * * * *

US006527166C1

(12) EX PARTE REEXAMINATION CERTIFICATE (10659th)

United States Patent

Focke et al.

(10) Number: US 6,527,166 C1

(45) Certificate Issued: Jul. 14, 2015

(54) BOX WITH A HINGED LID, FOR CIGARETTES

(75) Inventors: Heinz Focke, Verden (DE); Henry Buse, Visselhövede (DE)

(73) Assignee: FOCKE & CO. (GMBH & CO.), Verden (DE)

Reexamination Request:
No. 90/013,312, Aug. 4, 2014

Reexamination Certificate for:

| | |
|---|---|
| Patent No.: | **6,527,166** |
| Issued: | **Mar. 4, 2003** |
| Appl. No.: | **09/857,696** |
| PCT Filed: | **Nov. 30, 1999** |
| PCT No.: | **PCT/EP99/09307** |
| § 371 (c)(1), (2), (4) Date: | **Jun. 8, 2001** |
| PCT Pub. No.: | **WO00/34150** |
| PCT Pub. Date: | **Jun. 15, 2000** |

(30) Foreign Application Priority Data

| | | |
|---|---|---|
| Dec. 10, 1998 | (DE) | 198 57 118 |
| Dec. 18, 1998 | (DE) | 198 58 786 |

(51) Int. Cl.
*B65D 85/10* (2006.01)

(52) U.S. Cl.
CPC ..... *B65D 85/1045* (2013.01)

(58) Field of Classification Search
None
See application file for complete search history.

(56) References Cited

To view the complete listing of prior art documents cited during the proceeding for Reexamination Control Number 90/013,312, please refer to the USPTO's public Patent Application Information Retrieval (PAIR) system under the Display References tab.

*Primary Examiner* — Joseph Kaufman

(57) ABSTRACT

A hinge-lid box for cigarettes has a box part (10) and lid (11). A lid front wall (19) and a box front wall (15) form closing edges which are located opposite each other, specifically a lid closing edge (34) and an opposing closing edge (35). The closing edges (34, 35) are arranged at a distance from each other in such a way that, in the region of a field of view or a gap (40) which assumes different shapes, a sub-area of a collar (28), specifically a collar front wall (29), is visible.

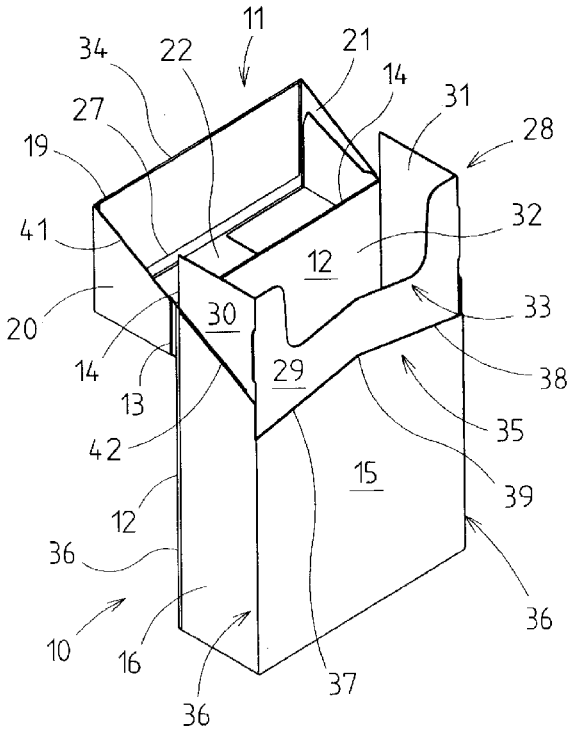

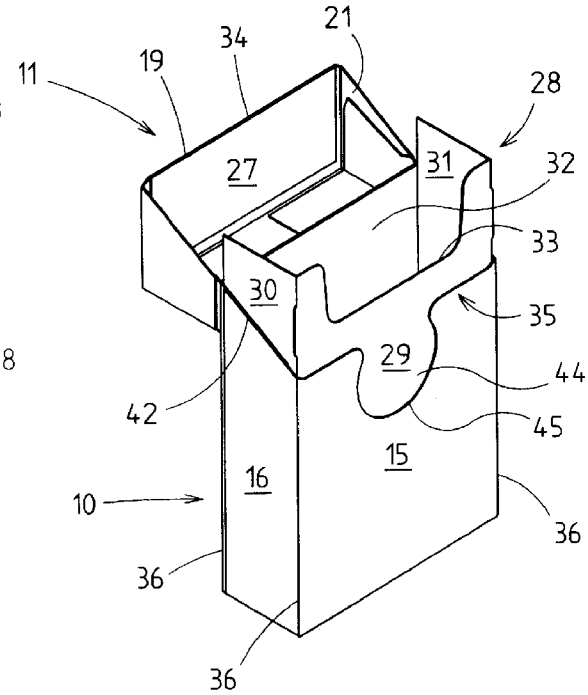

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claims 1 and 8 are determined to be patentable as amended.

Claim 2, dependent on an amended claim, is determined to be patentable.

Claims 4-7, 9 and 10 were not reexamined.

1. A hinge-lid box for cigarettes *formed from a box blank, the hinge-lid box* comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening, the lid closing edge (34) has a continuously rectilinear course oriented transversely with respect to upright pack edges (36), the lid closing edge (34) is a folding edge between the lid front wall (19) and a lid inner tab (27) resting on the inside of the said lid front wall (19), [and]

the opposing closing edge (35) has a course which differs from the lid closing edge (34), specifically being curved or angled,

*the box blank comprising a plurality of flaps for the box part (10) and a plurality of flaps for the lid (11) which are connected together and separated by a hinge line of a hinge (14),*

*the box front wall (15) is a first end flap of the of the box blank, a free edge of the box front wall being the upper opposing closing edge (35) of the box part (10) and being curved or angled,*

*the lid inner tab (27) being a second end flap of the box blank and being located at an opposing end of the box blank opposite the first end flap, the lid inner tab (27) being folded on an inner side of the lid front wall (19), and*

*the collar (28) and the collar front wall (29) lying entirely in a plane separate from a plane of the box front wall (15) and the lid front wall (19) when the lid (11) is closed.*

8. A hinge-lid box for cigarettes *formed from a box blank, the hinge-lid box* comprising a box part (10) and a lid (11) hinged on a box rear wall (12), and also comprising a collar (28) with a collar front wall (29) and collar side walls (30, 31), a lower lid closing edge (34) of a lid front wall (19) being located at a distance opposite an upper opposing closing edge (35) of a box front wall (15) when the lid (11) is closed, thereby forming an opening with an exposed area of the collar front wall (29), characterized in that the lid closing edge (34) and the opposing closing edge (35) have a non-uniform distance from each other in an area of the opening, specifically a distance which varies over a width of the opening;

in that the opposing closing edge (35) forms a depression (44) in a region thereof; and in that the opposing closing edge (35) runs rectilinearly outside a region of the depression (44), the correspondingly designed rectilinear lid closing edge (34) resting on the opposing closing edge (35) outside the depression (44),

*the box blank comprising a plurality of flaps for the box part (10) and a plurality of flaps for the lid (11) which are connected together and separated by a hinge line of a hinge (14),*

*the box front wall (15) is a first end flap of the of the box blank, a free edge of the box front wall being the upper opposing closing edge (35) of the box part (10) and being curved or angled,*

*the lid inner tab (27) being a second end flap of the box blank and being located at an opposing end of the box blank opposite the first end flap, the lid inner tab (27) being folded on an inner side of the lid front wall (19), and*

*the collar (28) and the collar front wall (29) lying entirely in a plane separate from a plane of the box front wall (15) and the lid front wall (19) when the lid (11) is closed.*

* * * * *